US010968576B2

(12) United States Patent
Wagner et al.

(10) Patent No.: US 10,968,576 B2
(45) Date of Patent: Apr. 6, 2021

(54) SELF-PROPELLED CONSTRUCTION MACHINE AND METHOD FOR WORKING GROUND PAVEMENTS

(71) Applicant: Wirtgen GmbH, Windhagen (DE)

(72) Inventors: Stefan Wagner, Bad Honnef (DE); Markus Bach, Bonn (DE); Christian Berning, Zülpich (DE); Axel Mahlberg, Hennef (DE)

(73) Assignee: Wirtgen GmbH

( * ) Notice: Subject to any disclaimer, the term of this patent is extended or adjusted under 35 U.S.C. 154(b) by 0 days.

(21) Appl. No.: 16/426,479

(22) Filed: May 30, 2019

(65) Prior Publication Data

US 2019/0390417 A1 Dec. 26, 2019

(30) Foreign Application Priority Data

Jun. 22, 2018 (DE) ..... 10 2018 210 253.8

(51) Int. Cl.
*E01C 23/00* (2006.01)
*E01C 23/088* (2006.01)
(Continued)

(52) U.S. Cl.
CPC ..... *E01C 23/088* (2013.01); *E01C 23/065* (2013.01); *E21C 47/00* (2013.01)

(58) Field of Classification Search
CPC ..... E01C 23/065; E01C 23/088; E21C 47/00
(Continued)

(56) References Cited

U.S. PATENT DOCUMENTS 7,905,682 B2 3/2011 Holl et al.
9,085,857 B2 7/2015 Held et al.
(Continued)

FOREIGN PATENT DOCUMENTS

EP 2644775 A2 10/2013
WO 03064770 A1 8/2003

OTHER PUBLICATIONS

European Search Report for corresponding EP 19 16 6117, dated Jun. 17, 2019, 4 pages (not prior art).

*Primary Examiner* — Raymond W Addie
(74) *Attorney, Agent, or Firm* — Lucian Wayne Beavers; Gary L. Montle; Patterson Intellectual Property Law, PC

(57) ABSTRACT

In a self-propelled construction machine (1), in particular road milling machine, recycler, stabilizer or surface miner, comprising a machine frame (4), at least two travelling devices (2), at least one hydraulic drive system (50) for driving at least two travelling devices (2), at least one working device, in particular a milling drum (6), for working the ground pavement (3), it is provided for the following features to be achieved: a detection device (44, 60, 62) is provided which detects fluctuations in the longitudinal speed ($v_{act}$) of the construction machine (1) during movement of the construction machine (1), wherein a control unit (38) controls the hydraulic drive system (50) as a function of the detected fluctuations in such a fashion that the drive speed ($v_{drive}$) for driving the travelling devices (2) specified by means of the hydraulic drive system (50) is continuously adjusted so that the detected fluctuations are reduced or compensated for.

20 Claims, 3 Drawing Sheets

(51) Int. Cl.
*E01C 23/06* (2006.01)
*E21C 47/00* (2006.01)

(58) Field of Classification Search
USPC ..... 404/72, 75, 84.05–84.5, 96–101, 117, 404/118, 133.1
See application file for complete search history.

(56) References Cited

U.S. PATENT DOCUMENTS

| | | | | |
|---|---|---|---|---|
| 2003/0082003 | A1* | 5/2003 | Potts | E02D 3/074 404/117 |
| 2004/0120766 | A1 | 6/2004 | Silay | |
| 2012/0203475 | A1* | 8/2012 | Wilkens | E01C 23/20 702/47 |
| 2017/0233957 | A1* | 8/2017 | Eul | B60K 23/0808 404/84.05 |

* cited by examiner

SELF-PROPELLED CONSTRUCTION MACHINE AND METHOD FOR WORKING GROUND PAVEMENTS

CROSS-REFERENCES TO RELATED APPLICATIONS

This application claims benefit of German Patent Application No. 10 2018 210 253.8, filed Jun. 22, 2018, and which is hereby incorporated by reference.

FIELD OF THE DISCLOSURE

The invention relates to a self-propelled construction machine as claimed, as well as to a method for working ground pavements.

BACKGROUND

Self-propelled construction machines are known, in particular road milling machines, recyclers, stabilizers or surface miners comprising a machine frame, travelling devices, at least one hydraulic drive system for driving the travelling devices, and at least one working device, in particular a milling drum for working the ground surface.

The road milling machines can be used, for example, to remove existing ground pavements of roads. Recyclers can be used to rehabilitate existing ground pavements. The stabilizers serve the purpose of preparing the sub grade for road construction. Surface miners can be used to mine coal and rock.

Experience has shown, however, that vibrations may occur during the operation of the construction machines caused by, for example, a non-smooth operation of the working device. This may lead to an excitation of vibrations in the entire construction machine to the point of the machine rocking, in particular when the vibrations are in the range of the machine's resonant frequency. According to prior art, such rocking of the machine is prevented by the machine operator changing the speed of the construction machine and driving more slowly. This has the disadvantage, however, that the machine cannot be operated or moved at the desired speed, and that, as a consequence, the construction machine is not optimally utilized.

BRIEF SUMMARY

It is an object of the present invention to create a construction machine and a method for working ground pavements in which rocking of the construction machine is avoided or optimized operation of the construction machine is made possible, respectively.

The invention advantageously provides for a detection device to be provided which detects fluctuations in the longitudinal speed of the construction machine during movement of the construction machine, wherein a control unit controls the hydraulic drive system as a function of the detected fluctuations in such a fashion that the drive speed for driving the travelling devices specified by means of the hydraulic drive system is continuously adjusted so that the detected fluctuations are reduced or compensated for.

The present invention has the advantage that the fluctuations of the construction machine are avoided or reduced, respectively, so that rocking is effectively prevented. At the same time, the average longitudinal speed of the construction machine may advantageously remain the same. It is therefore no longer necessary to reduce the set speed of the construction machine, and the construction machine may be operated at the desired set speed.

In the present invention, preferably at least two travelling devices are driven. It is, however, also possible for only two travelling devices to be driven and further non-driven travelling devices to be additionally provided.

In the present invention, it must be differentiated between the longitudinal speed of the construction machine, the set speed, and the specified drive speed. The longitudinal speed is the actual speed of the construction machine. The set speed is the speed which the operator of the construction machine can set on the operating unit. It must be distinguished from the specified drive speed in the hydraulic drive system. This is the drive speed specified by the control unit. The longitudinal speed of the construction machine is a superimposition of the specified drive speed and influencing factors of the machine or the environment. The specified drive speed may be superimposed by fluctuations which are caused, for example, by a non-smooth operation of the working device. The specified drive speed is the speed that would ensue in the case of given operating parameters of the hydraulic drive system and without any influencing factors.

The fluctuations in the longitudinal speed of the construction machine may be detectable as a vibration by means of the detection device. The detectable vibration preferably exhibits an essentially fixed frequency. Particularly disturbing fluctuations are generated by vibrations which hit the resonant frequency of the machine so that rocking of the machine occurs.

The resonant frequency of the machine depends on different operating variables, such as the current weight (again depending, inter alia, on the amount of fuel and water present in tanks) and other factors. Said frequency is therefore variable and cannot therefore be generally determined for a machine.

The fluctuations in the longitudinal speed have an effect on the body, on the one hand, in that perceptible "rocking movements" occur; on the other hand, however, the fluctuation also has an effect on the hydraulic drive system. The movements of the machine are transferred back to the hydraulic circuit via the ground-engaging units and the hydraulic motors, and may there also be detected as fluctuations in the pressure or in the volumetric flow rate, respectively.

The control unit may control the hydraulic drive system in such a fashion that the specified drive speed is changed periodically to generate a counter-vibration which reduces or compensates for the detected fluctuations.

In this way, the speed set by the operator of the construction machine does not have to be changed to prevent the unwelcome fluctuation of the construction machine.

The control unit may control the hydraulic drive system in such a fashion that the frequency of the counter-vibration is adjusted to the frequency of the detected vibration and is phase-shifted to the same. The phase shift may also be adjusted continuously.

The control unit may control the hydraulic drive system in such a fashion that the frequency of the counter-vibration is opposite in phase to the frequency of the detected vibration.

The control unit may control the hydraulic drive system in such a fashion that the amplitude of the counter-vibration is adjusted to the amplitude of the detected vibration.

Through the adjustment to the frequency and to the amplitude of the detected vibration, the unwelcome detected vibration may be particularly effectively reduced or compensated for.

The hydraulic drive system may comprise at least one hydraulic pump and at least one hydraulic motor. Furthermore, the hydraulic drive system may also comprise lines and additional elements such as, for example, pressure storage reservoirs.

The at least one hydraulic pump may be an axial piston pump. The hydraulic motor may likewise be an axial piston motor.

The control unit may control the volumetric flow rate and/or the pressure in the hydraulic drive system so as to effect a periodical change in the specified drive speed.

The volumetric flow rate and/or the pressure in the hydraulic drive system may be controllable by means of the hydraulic pump for adjusting the specified drive speed.

The displacement capacity of the hydraulic motor may likewise be adjustable so as to effect a periodical change in the specified drive speed.

The control unit may control the hydraulic drive system in such a fashion that the drive speed for driving the travelling devices specified by means of the hydraulic drive system is continuously adjusted only when the detected vibration exceeds a predefined amplitude.

In this way, the fluctuations that are particularly unpleasant for the machine operator, in which rocking of the machine occurs, are compensated for or reduced first.

The detection device may detect fluctuations in the longitudinal speed as fluctuations in the longitudinal speed around the set speed. The detection device may detect the fluctuations on the travelling devices or on the machine frame and/or as a fluctuation in the volumetric flow rate and/or as a fluctuation in the pressure of the hydraulic drive system. During rocking of the construction machine, tilting back and forth of the construction machine may also occur. Vertical fluctuations may therefore also be measured which allow a conclusion to be drawn as to the fluctuations in longitudinal speed.

The detection device may comprise a pick-up sensor and/or an accelerometer and/or a measuring device for measuring the fluctuations in pressure in the hydraulic drive system. An accelerometer measures the changes in speed, which enables the fluctuations in the longitudinal speed to be determined. Furthermore, changes in the volumetric flow rate of the hydraulic fluid in the hydraulic system, for example, may be measured with an appropriate sensor.

According to the present invention, a method for working ground pavements may likewise be provided, comprising a construction machine self-propelled by means of travelling devices, in particular road milling machine, recycler, stabilizer or surface miner, in which the travelling devices are driven by a hydraulic drive system, wherein a working device works the ground pavement. In this context, it may in particular be provided that fluctuations in the longitudinal speed of the construction machine are detected during movement of the construction machine, and the drive speed specified by the hydraulic drive system for the travelling devices is continuously adjusted as a function of the detected fluctuation so that the detected fluctuations of the construction machine are reduced or compensated for.

The fluctuations in the longitudinal speed of the construction machine may be detected as vibrations with an essentially fixed frequency.

The specified drive speed may be changed periodically to generate a counter-vibration which reduces or compensates for the detected fluctuations.

The frequency of the counter-vibration may be adjusted to the frequency of the detected vibration and may be phase-shifted to the same.

The frequency of the counter-vibration may be adjusted in such a fashion that it is opposite in phase to the frequency of the detected vibration.

According to the present invention, it is decisive that the specified drive speed does not change in its average during the adjustment but merely vibrates around the desired set travel speed.

BRIEF DESCRIPTION OF THE SEVERAL VIEWS OF THE DRAWINGS

Hereinafter, embodiments of the invention are illustrated in more detail with reference to the drawings.

DETAILED DESCRIPTION

Figure 1:
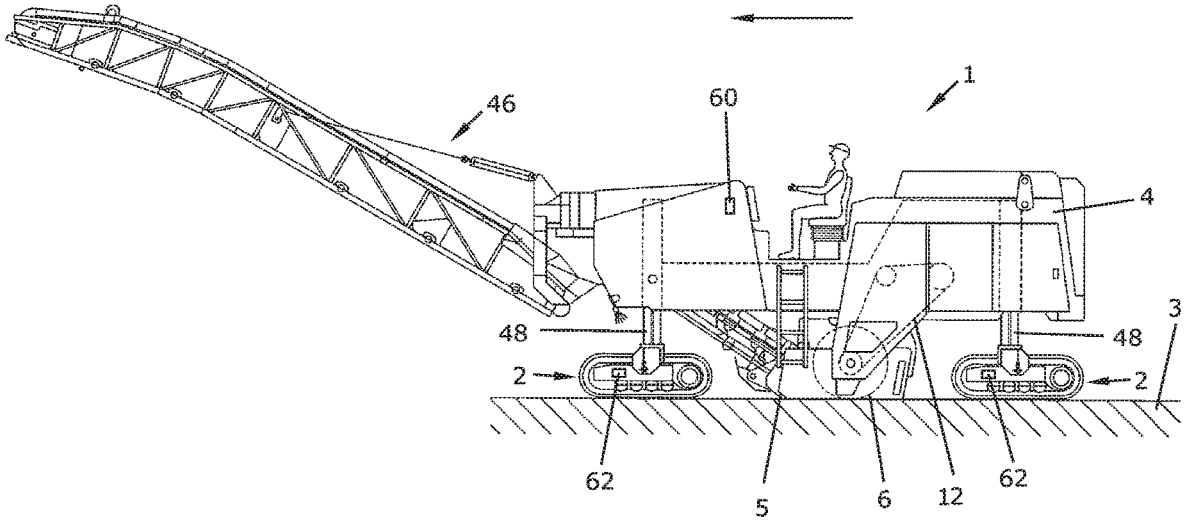
FIG. 1 shows schematically a self-propelled construction machine in side view.

FIG. 1 shows a construction machine 1. The construction machine may be a milling machine, in particular a road milling machine, a recycler or stabilizer, or a surface miner. The construction machine depicted in FIG. 1 has the form of a road milling machine. The construction machine 1 may, however, also be any other construction machine comprising, as a minimum, a hydraulic drive system and a working device. The depicted construction machine 1 comprises travelling devices 2 which support a machine frame 4. The travelling devices 2 may be tracked ground-engaging units or wheels. A working device, preferably a milling drum 6 for working the ground pavement 3, is mounted on the machine frame 4. To work the ground pavement 3, the milling drum 6 may comprise non-depicted milling tools on the shell surface of the milling drum 6. A milling drum housing 5 is arranged around the milling drum 6. The construction machine furthermore preferably comprises a conveying device 46 for transporting away the milling material.

The travelling devices 2 may be connected to the machine frame 4 via lifting columns 48. The machine frame 4 may be adjustable in height by means of the lifting columns 48. As a result, the milling drum 6 may also be adjusted in height. Alternatively or additionally, the milling drum 6 may, in turn, be mounted in a movable, in particular height-adjustable fashion relative to the machine frame 4.

Figure 2:
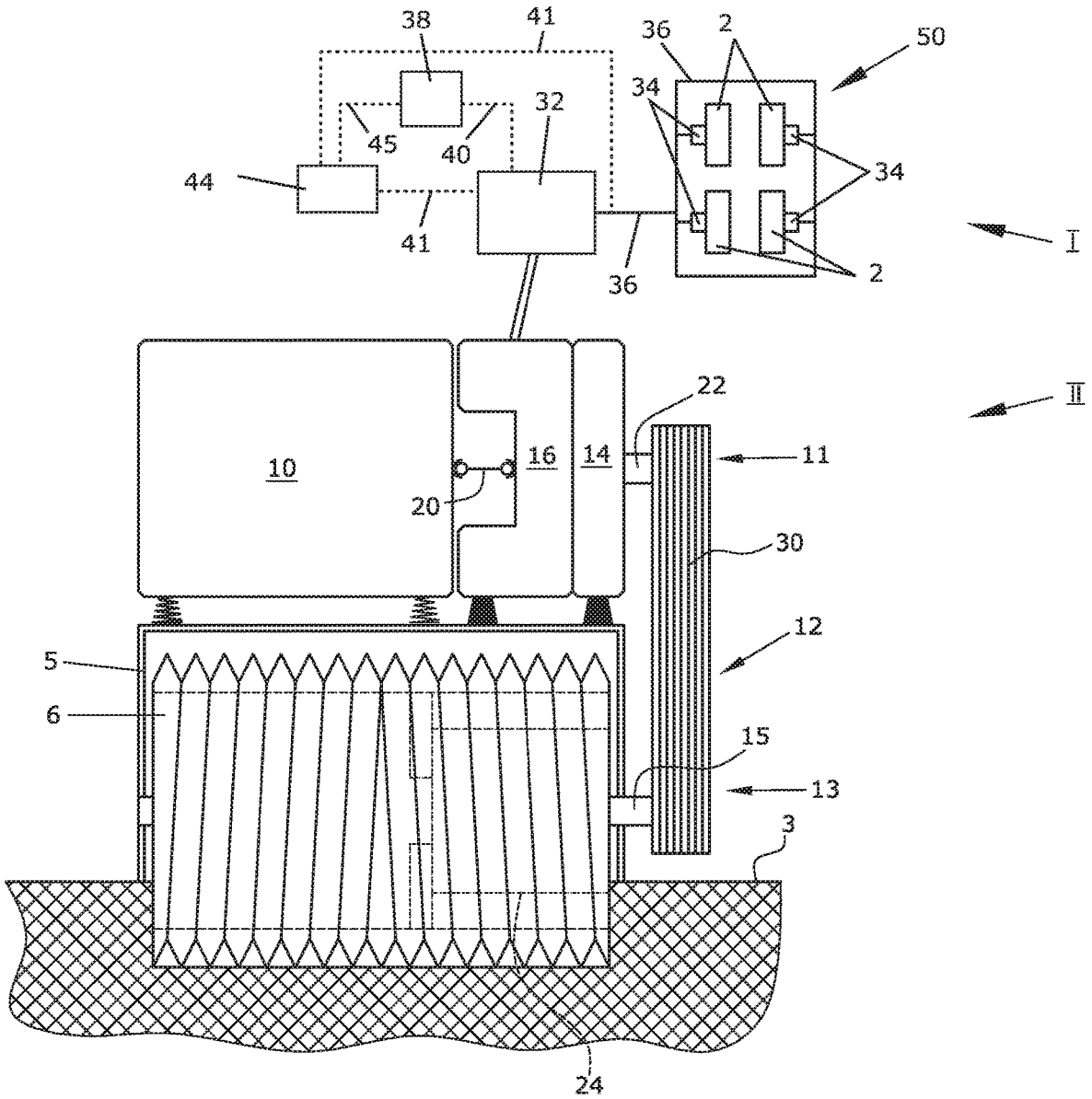
FIG. 2 shows schematically drive trains of the construction machine.

FIG. 2 shows a drive train of the construction machine 1. A first drive train I serves the purpose of transmitting the driving power to the travelling devices 2, while a second drive train II serves the purpose of transmitting the driving power to the milling drum 6.

A drive unit 10 is depicted in FIG. 2. Said drive unit 10 may preferably comprise a combustion engine. Said combustion engine may in particular be a diesel engine. The drive unit may be provided, via an elastomer coupling 20, with a pump transfer gearbox 16 for driving the first drive train I for driving a hydraulic drive system 50 for driving the travelling devices 2.

In the second drive train II for driving the milling drum 6, a clutch 14 is provided between the drive unit 10 and the milling drum 6. Said clutch 14 is a device for switching the torque.

A traction mechanism 12 for the mechanical drive of the milling drum 6 is arranged between the clutch 14 and the milling drum 6. The traction mechanism 12 comprises a drive element 11 which is coupled, in a torsionally rigid fashion, to the driven shaft 22 of the drive unit 10. The traction mechanism 12 furthermore comprises a driven element 13 which is coupled, in a torsionally rigid fashion, to the drive shaft 15 of the milling drum 6. A gearbox, in particular a planetary gearbox 24, may additionally be arranged between the drive shaft 15 and the milling drum 6.

The traction mechanism 12 is preferably a belt drive, wherein the drive elements and driven elements consist of belt pulleys 11 and 13, with one or a plurality of drive belts 30 revolving over said belt pulleys 11 and 13. Alternatively, the traction mechanism 12 may also consist of a chain drive, wherein the drive elements and driven elements then consist of sprockets. In principle, the working device may also be hydraulically or electrically driven.

In the first drive train I for driving the hydraulic drive system, the pump transfer gearbox 16 comprises at least one hydraulic pump 32. The at least one hydraulic pump 32 may in turn be connected, via hydraulic lines 36, to at least one or, as in the embodiment depicted, a plurality of hydraulic motors 34. The hydraulic motors 34 drive one each travelling device 2, depicted only schematically in FIG. 2.

Due to the hydraulic drive system, the advance speed of the construction machine may, in principle, be controlled independently of the speed of revolution of the drive engine.

During the operation of a construction machine, fluctuations may occur in the longitudinal speed of the construction machine. Said fluctuations may be detected by means of a detection device 44. A control unit 38 may control the hydraulic drive system 50 as a function of the detected fluctuations in such a fashion that the drive speed for driving the travelling devices 2 specified by means of the hydraulic drive system 50 is continuously adjusted so that the detected fluctuations are reduced or compensated for. That the control unit 38 controls the hydraulic drive system 50 via the pump 32 is depicted by means of the dashed line 40. The measured values of the detection device 44 may be transmitted to the control unit 38. This is also depicted by means of a dashed line 45. The term to control is to be understood to mean that the detection unit 44 records a measured value at least once, and the control unit 38 controls the hydraulic drive system 50 as a function of the detected fluctuations. It is to also be included, however, that the detection device records measured values a plurality of times, and the control device 38 controls the hydraulic drive system 50 as a function of the detected fluctuations. A feedback in the sense of a closed-loop control is therefore to also be included in the present term to control.

The detection device 44 may detect the fluctuations in the longitudinal speed as a fluctuation in the longitudinal speed around the set speed. The detection device 44 may detect the fluctuations on the travelling devices 2 or on the machine frame and/or as a fluctuation in the volumetric flow rate and/or as a fluctuation in the pressure of the hydraulic drive system.

In the embodiment depicted, the detection device 44 detects the fluctuations in the volumetric flow rate and/or the fluctuations in the pressure in the hydraulic drive system 50. The detection device 44 may measure the fluctuations at any position of the drive system 50, such as the hydraulic pump 32 or the hydraulic lines 36. This is also depicted by means of dashed lines 41. The control unit 38 may be part of the machine control system of the construction machine 1. The control unit 38 may, however, also be designed separately.

Figure 3:
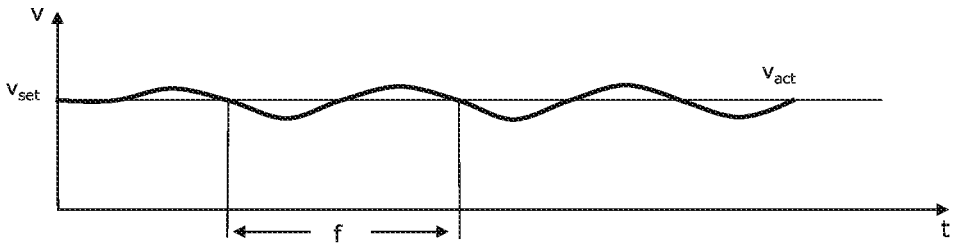
FIG. 3 shows schematically the progression of the detected longitudinal speed.

FIG. 3 shows the longitudinal speed $v_{act}$ over time. The depicted detected longitudinal speed $v_{act}$ exhibits fluctuations which fluctuate around a set speed $v_{set}$. The set speed $v_{set}$ is the speed which the driver can set on an operating unit. The detected longitudinal speed is termed $v_{act}$. The detected fluctuations are, as depicted, a vibration with a fixed frequency f. Such rocking of the construction machine frequently occurs when vibrations occur on the construction machine which hit a resonant frequency of the construction machine. In the prior art, said fluctuations could be counteracted only by reducing the set speed $v_{set}$ in order to reduce the vibrations which cause the machine to rock. This has the disadvantage, however, that the construction machine is moved more slowly altogether than would generally be possible due to the available machine power.

Figure 4:
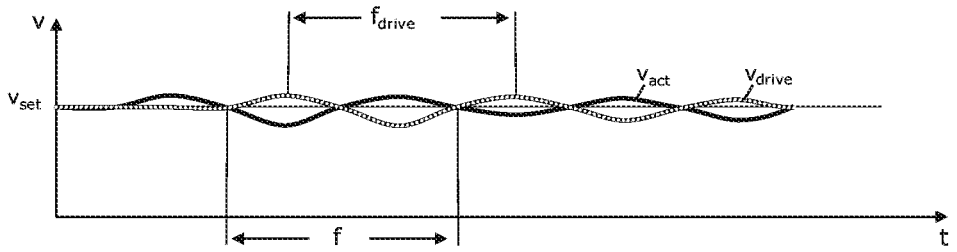
FIG. 4 shows schematically the progression of the detected longitudinal speed and the progression of the drive speed specified by means of the hydraulic drive system.

In the present invention, however, the fluctuation is detected by means of a detection device 44. The control device 38 controls the hydraulic drive system in such a fashion that the drive speed $v_{drive}$ for driving the travelling device 2 specified by means of the hydraulic drive system is continuously adjusted so that the detected fluctuations are reduced or compensated for. This is depicted in FIG. 4. The detected speed $v_{act}$ (solid line) is depicted. Said detected speed fluctuates around a speed $v_{set}$ set by the machine operator. The control unit now controls the hydraulic drive system in such a fashion that the specified drive speed $v_{drive}$ (dotted line) is changed in such a fashion that the fluctuations are reduced or compensated for, respectively. This is also apparent in FIG. 4. The specified drive speed $v_{drive}$ is a counter-vibration to the detected fluctuation. As a result, the detected fluctuations reduce over time. The specified drive speed $v_{drive}$ is also adjusted so that, in the end, the detected fluctuation of the construction machine reduces to such an extent that the longitudinal speed of the construction machine nearly aligns itself to the specified speed $v_{set}$.

It is apparent in FIG. 4 that the control unit 38 controls the hydraulic drive system in such a fashion that the specified drive speed $v_{drive}$ is changed periodically in order to generate a counter-vibration which reduces or compensates for the detected fluctuations. In the process, the frequency of the counter-vibration is adjusted to the frequency of the detected vibration and is phase-shifted to the same. It is particularly preferred for the frequency of the counter-vibration to be opposite in phase to the frequency of the detected vibration. Likewise, the amplitude of the counter-vibration is preferably adjusted to the amplitude of the detected vibration. In this process, the amplitude of the detected vibrations is equivalent, for example, to the maximum deviation of the detected longitudinal speed $v_{act}$ from the set speed $v_{set}$, whilst the amplitude of the counter-vibration is equivalent, for example, to the maximum deviation of the specified drive speed $v_{drive}$ from the set speed $v_{set}$.

The control unit 38 may adjust the drive speed in the hydraulic drive system 50 by adjusting the volumetric flow rate and/or the pressure of the hydraulic drive system by means of the hydraulic pump 32. Alternatively, the control unit 38 may also adjust the drive speed in the hydraulic drive system 50 by adjusting the volumetric flow rate and/or the pressure of the hydraulic drive system in a position other than the hydraulic pump 32. This may be effected, for example, by means of an additional, non-depicted, hydraulic actuator.

The displacement capacity of the hydraulic motors 34 may alternatively also be adjusted so as to effect a periodical change in the specified drive speed.

It may be provided for the control unit 38 to continuously adjust the specified drive speed $v_{drive}$ only when the detected fluctuation $v_{act}$ exceeds a predefined amplitude.

In this way, the construction machine may be moved at any desired speed $v_{set}$ and, in contrast to the prior art, as a result of not having to reduce the specified speed $v_{set}$, the construction machine may therefore also be operated at a higher or at the optimum speed, respectively.

Additional or alternative detection devices are depicted in the construction machine according to FIG. 1. A detection device 60 designed as an accelerometer, and a detection device 62 designed as a pick-up sensor are depicted. Said detection devices may be used, alternatively or additionally, to reliably detect fluctuations in the longitudinal speed of the construction machine. Said detection devices may, however, also be omitted.

What is claimed is:

1. A self-propelled construction machine for working ground pavements, the self-propelled construction machine comprising:

at least two travelling devices supporting a machine frame;

at least one hydraulic drive system configured to drive the at least two travelling devices at a specified drive speed;

a detection device configured to detect fluctuations in a longitudinal speed of the construction machine during movement of the construction machine, wherein the fluctuations in the longitudinal speed of the construction machine are detectable as a vibration by the detection device; and a control unit configured to control the hydraulic drive system to continuously adjust the drive speed as a function of the detected fluctuations.

2. The self-propelled construction machine of claim 1, wherein said vibration exhibits an essentially fixed frequency.

3. The self-propelled construction machine of claim 1, wherein the detection device is configured to detect fluctuations in the longitudinal speed as a fluctuation in one or more of: the longitudinal speed around a set speed on the travelling devices; the longitudinal speed around a set speed on the machine frame; the volumetric flow rate; and the pressure of the hydraulic drive system.

4. The self-propelled construction machine of claim 3, wherein the detection device comprises one or more of: a pick-up sensor for measuring the speed changes; an accelerometer for measuring the speed changes; and a measuring device for measuring the fluctuations in pressure or the volumetric flow rate in the hydraulic drive system.

5. A method for working ground pavements via a working device of a construction machine that is self-propelled by means of travelling devices, in which the travelling devices are driven by a hydraulic drive system at a specified drive speed, the method comprising:

detecting fluctuations in a longitudinal speed of the construction machine during movement of the construction machine, wherein the fluctuations in the longitudinal speed of the construction machine are detected as vibrations; and continuously adjusting the drive speed as a function of the detected fluctuations.

6. The method of claim 5, wherein the fluctuations in the longitudinal speed of the construction machine are detected as vibrations exhibiting an essentially fixed frequency.

7. The method of claim 5, wherein the specified drive speed is changed periodically to generate a counter-vibration which reduces or compensates for the detected fluctuations.

8. The method of claim 7, wherein a frequency of the counter-vibration is adjusted to the frequency of the detected vibration and is phase-shifted to the same.

9. The method of claim 8, wherein the frequency of the counter-vibration is phase-shifted opposite in phase to the frequency of the detected vibration.

10. A self-propelled construction machine for working ground pavements, the self-propelled construction machine comprising:

at least two travelling devices supporting a machine frame;

a hydraulic drive system comprising at least one hydraulic pump coupled to at least one hydraulic motor and configured to drive each of the at least two travelling devices at a specified drive speed;

a detection device configured to detect fluctuations in a longitudinal speed of the construction machine during movement of the construction machine as a fluctuation in a volumetric flow rate and/or pressure of the hydraulic drive system as measured at the hydraulic pump; and a control unit configured to control the hydraulic drive system to continuously adjust the drive speed as a function of the detected fluctuations.

11. The self-propelled construction machine of claim 10, wherein the displacement capacity of the at least one hydraulic motor is adjustable to effect a periodical change in the specified drive speed.

12. The self-propelled construction machine of claim 10, wherein the control unit is configured to control one or more of the volumetric flow rate and the pressure in the hydraulic drive system to effect a periodical change in the specified drive speed.

13. The self-propelled construction machine of claim 10, wherein the detection device comprises one or more of:

a pick-up sensor for measuring the speed changes;

an accelerometer for measuring the speed changes; and a measuring device for measuring the fluctuations in pressure or the volumetric flow rate in the hydraulic drive system.

14. The self-propelled construction machine of claim 10, wherein the fluctuations in the longitudinal speed of the construction machine are detectable as a vibration by the detection device.

15. The self-propelled construction machine of claim 14, wherein the control unit is configured to control the hydraulic drive system such that the drive speed is continuously adjusted only when the detected vibration exceeds a predefined amplitude.

16. The self-propelled construction machine of claim 14, wherein said vibration exhibits an essentially fixed frequency.

17. The self-propelled construction machine of claim 10, wherein the control unit is configured to control the hydraulic drive system such that the specified drive speed is changed periodically to generate a counter-vibration which reduces or compensates for the detected fluctuations.

18. The self-propelled construction machine of claim 17, wherein the control unit is configured to control the hydraulic drive system such that the amplitude of the counter-vibration is adjusted to the amplitude of the detected vibration.

19. The self-propelled construction machine of claim 17, wherein the control unit is configured to control the hydraulic drive system such that the frequency of the counter-vibration is adjusted to the frequency of a detected vibration and is phase-shifted to the same.

20. The self-propelled construction machine of claim 19, wherein the frequency of the counter-vibration is phase-shifted opposite in phase to the frequency of the detected vibration.

* * * * *